United States Patent [19]

Eckels et al.

[11] 4,290,584

[45] Sep. 22, 1981

[54] POLE MOUNTED WINCH

[75] Inventors: George H. Eckels, Overland Park, Kans.; Donald H. Groft, Forty Fort, Pa.; Wayne R. Stallard, Mission, Kans.

[73] Assignee: Stelco Inc., Kansas City, Kans.

[21] Appl. No.: 714,854

[22] Filed: Aug. 16, 1976

[51] Int. Cl.[3] ..... B66F 9/00

[52] U.S. Cl. ..... 254/380; 182/2; 242/100; 242/106; 248/309 A

[58] Field of Search ..... 254/145, 161, 186 R, 254/162, 163; 182/2; 187/27; 81/57.28, 57.29, 57.3, 57.31, 57.13, 57.14, , 57.11, ; 248/14, 16, 231, 214, 215, 223, 243, 222.3, 309 A, 225.2; 242/100, 100.1, 100.2, 106

[56] References Cited

U.S. PATENT DOCUMENTS

| | | | |
|---|---|---|---|
| 782,478 | 2/1905 | Yeager | 242/100 |
| 900,823 | 10/1908 | Blackledge et al. | 242/100 |
| 1,027,655 | 5/1912 | Johnson | 242/100 |
| 1,347,196 | 7/1920 | Werner | 254/162 |
| 2,132,548 | 10/1938 | Stockwell et al. | 242/100 |
| 3,062,477 | 11/1962 | Horning | 242/100.1 |
| 3,165,297 | 1/1965 | Thompson et al. | 254/186 |
| 3,265,361 | 8/1966 | Mayrath | 254/186 HC |
| 3,494,492 | 2/1970 | Thiermann | 254/145 X |
| 3,710,893 | 1/1973 | Hippach | 182/2 |
| 3,784,165 | 1/1974 | Pruitt | 254/168 |
| 3,979,977 | 9/1976 | Dorma | 81/57.29 X |
| 4,013,253 | 3/1977 | Perrault et al. | 248/223.3 |

FOREIGN PATENT DOCUMENTS

| | | | |
|---|---|---|---|
| 7895 | of 1903 | United Kingdom | 248/215 |

*Primary Examiner*—Joseph F. Peters, Jr.
*Assistant Examiner*—D. W. Underwood
*Attorney, Agent, or Firm*—Lowe, Kokjer, Kircher, Wharton & Bowman

[57] ABSTRACT

A portable winch includes a base plate which is adapted to be quickly and easily coupled with and uncoupled from a bracket attached to a utility pole. The base plate hangs on the bracket and requires no tools or clamps to maintain the connection. The base plate and bracket have cooperating portions which stabilize the base plate in its operating position and prevent rocking, swinging or swaying. The winch can be supported so that the winch cable drops either on the outside or inside of the drum, thus to change the spacing of the cable from the pole. The control means for operating the winch can be carried on the basket of an aerial boom by a bracket which hangs on the lip of the basket. The bracket includes a support tongue on which the winch can be hung during its travel to and from the pole. Alternately, the winch can be powered by a hand drill detachably coupled with the winch drive and held by a worker in the basket.

9 Claims, 7 Drawing Figures

POLE MOUNTED WINCH

BACKGROUND AND SUMMARY OF THE INVENTION

In utility construction and maintenance work it is necessary to elevate transformers and other relatively heavy and unwieldy objects to the top, or near the top, of a utility pole. Similiar needs occur from time to time in other fields.

The present invention is directed to the provision of a hoisting means for the purpose described which is capable of being temporarily mounted on the pole and which has many advantages over alternate lifting means of which we are presently aware.

One of the principal advantages is that the hoisting device according to our invention is a power operated winch which is provided with means for quickly and easily attaching it to and removing it from an operating position on the pole. The winch and its support bracket are separate items. The support bracket thus is capable of being mounted on the pole separately from the winch, making the task of connection of the bracket with the pole much easier than if the weight of the winch also had to be supported while establishing the connection.

Another advantage of our invention is that it provides a winch which is relatively light in weight and which can be easily lifted and supported in different positions on the pole to locate the winch cable at varying locations.

A further advantage of our invention is that it provides a portable winch arrangement in which no hand tools are required for mounting the winch on or removing it from its operating position on the pole.

Still another advantage is that the operation of the winch is controlled remotely, such as from the basket of any suitable aerial device of the type used in utility and other construction and maintenance work. In our arrangement, we provide one form of control for the winch in which the control is adapted to be removably mounted on the operator's basket of an aerial device. The connection between the control and winch is by flexible power supply lines. Thus the operator is able, while having full control over the functions of the winch, also to maneuver himself by means of movement of the basket to the most advantageous position to perform the work required. In another form, the winch control is in the form of a hand held power drill fitted with a tool head for detachable coupling with the winch drive.

A further advantage of the invention is that it provides means for carrying the winch in the basket in a standby location from which it can quickly and easily be removed from and attached to the pole.

Other and further objects and advantages of the invention, together with the features of novelty appurtenant thereto, will appear in the course of the following description.

DETAILED DESCRIPTION

In the accompanying drawings, which form a part of the specification and in which like reference numerals indicate like parts in the various views:

FIG. 1 shows a front elevational view of the preferred embodiment of a winch and mounting means according to the invention, the winch being mounted on a pole, and also showing at the left-hand side of the figure a fragment in cross section of a basket of an aerial device with the control means for the winch mounted thereon, and also illustrating, in broken lines, the standby and stored position for the winch in the basket during transport to and from the mounting position on the pole;

Figure 1:
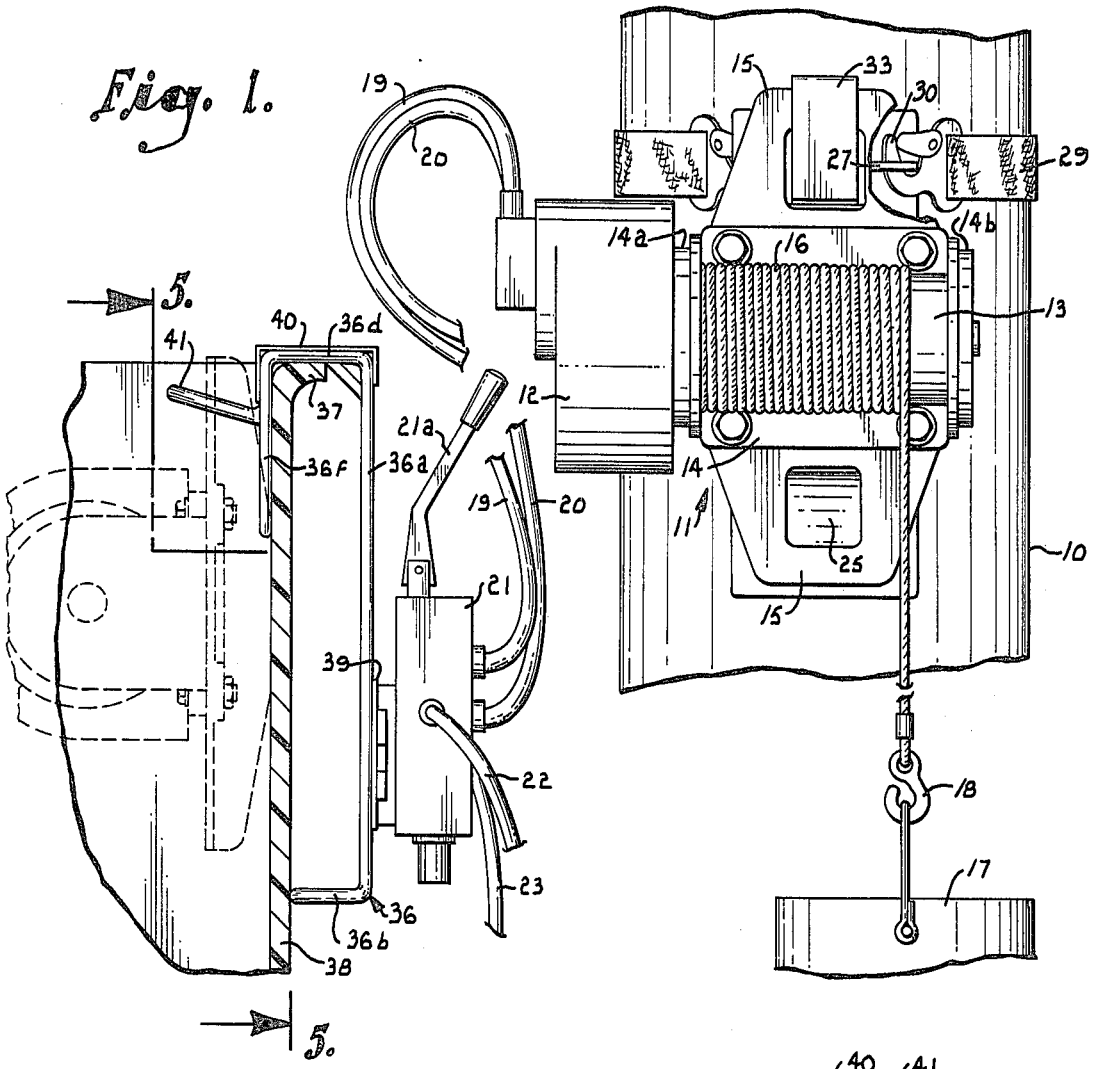

Referring now to the drawings, a portion of typical upright utility pole is indicated at 10. Mounted on the pole is a winch 11 which includes a hydraulic drive motor and worm drive speed reducer 12 which drives a rotary drum 13. While we show a hydraulic power source, it will become evident to those skilled in the art, as the description continues, that pneumatic or electric power may also be utilized.

The drum is suspended between the legs 14*a*, 14*b* of a U-shaped member 14. The web or the base portion of the U-shaped member 14 is bolted or otherwise secured to a base plate 15 which forms part of the mounting connection for supporting the winch from the post 10 and the details of which will subsequently be descirbed.

The winch drum carries a cable 16 and is adapted to be rotated by the motor means 12 in either direction thereby to either lift or lower a load 17, which can be connected to the cable by any conventional means such as the hook 18.

Coupled with the motor means 12 for the winch are the hydraulic lines 19 and 20 which also connect with a three position tandem valve 21. The connections at both the motor and valve are preferably detechable fittings. The valve in turn connects through lines 22, 23 with a source of hydraulic fluid (not shown) which can be carried on the vehicle equipment which is normally used in working with utility lines and the like. The valve 21 is a conventional valve having an operating lever 21*a* which can be manipulated to put the motor means 12 in a neutral lock position, in a forward drive condition or in a reverse drive condition. Such valves and motor means are well known to the art and the details thereof do not form any part of the invention and will not be further described.

Figure 4:
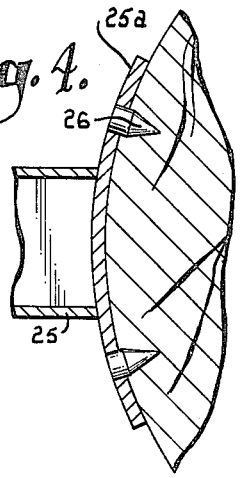
FIG. 4 is a fragmentary section, on an enlarged scale, taken on line 4—4 of FIG. 3 in the direction of the arrows.
Figure 2:
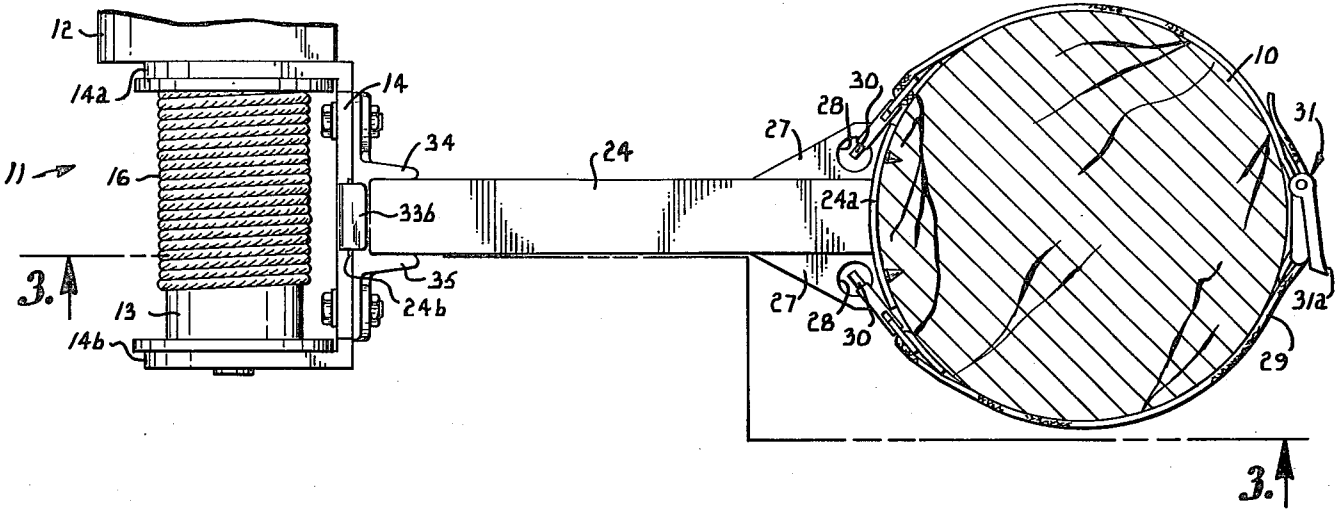
FIG. 2 is a fragmentary top plan view of the winch and mounting means, the pole being shown in horizontal section.
Figure 3:
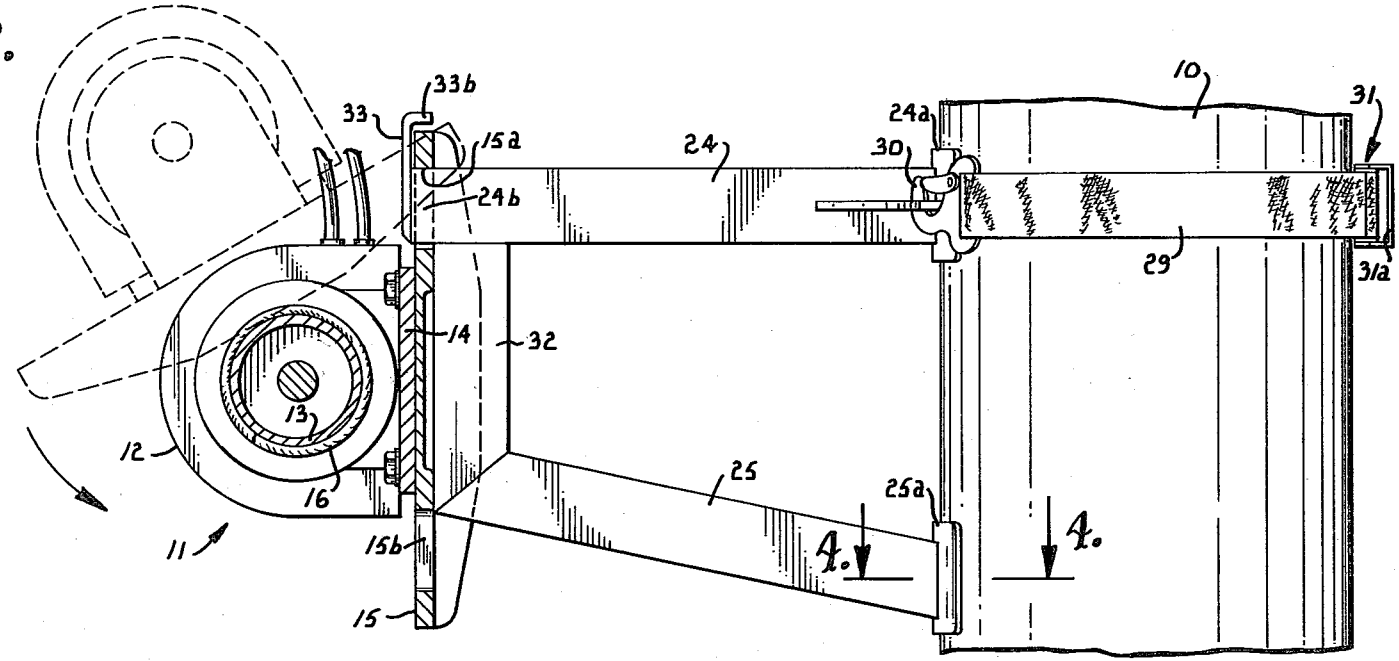
FIG. 3 is a partly sectional view taken generally along line 3—3 of FIG. 2 in the direction of the arrows.

Continuing now with further description of the winch and the means for mounting the winch to the pole, the mounting bracket for the winch is best seen in FIGS. 2 and 3. The bracket comprises upper and lower bracket members 24 and 25 which are arranged to extend outwardly from the surface of the post with their axes in the same vertical plane. Preferably members 24 and 25 are constructed of steel tube. Each of the members 24 and 25 has an arcuate footing 24*a* or 25*a* which is adapted to rest against the surface of the post and conform generally to the curvature thereof. Each of these footings is provided with spikes 26 (see FIG. 4)

which assist in the overall support function. For concrete poles, the footings utilize rubber pads instead.

The upper bracket element 24 is equipped with two oppositely located side gussets 27. Each of these gussets is provided with an aperture 28. The gussets and apertures provide a means of securing a retaining strap 29 around the post, the retaining strap having the hook portions 30 which engage in the openings in the gussets. Strap 29 is further equipped with a ratchet buckle 31 which performs the function of tightening the strap securely to the post in response to manipulation of the handle portion 31*a*.

A strap tensioning device of character satisfactory for use in connection with our invention is disclosed in U.S. Pat. No. 3,180,623, issued Apr. 27, 1965.

At the outer end of the winch mounting bracket the upper and lower members 24 and 25 are joined by a vertical member 32 which preferably is also made of tubular material. The location of the member 32 and the length of the lower member 25 are such that the outer end of the upper member 24 extends past member 32 in order to provide a horizontal extension or projection 24*b*. This extension has secured to its end a locking flange or tab 33 which extends upwardly past the top surface of the member 24 and terminates in a horizontally bent flange portion 33*b* which overlies a portion of the upper surface of the projection 24*b*.

As earlier described, the winch mounting plate 15 is either bolted to or made integral with the base of the winch. The mounting plate is, in its preferred form, a symmetrically structured device having rectangular openings 15*a* and 15*b* near the opposite ends. The openings 15*a* and 15*b* are of slightly greater inside dimensions than the outside dimensions of the tube member 24. The location of the outermost edge of each opening 15*a* and 15*b* is such that the outer end of each plate can, when the winch is hung on the support bracket, fit under the flange 33*b* as shown in FIG. 3.

The rear face of the mounting plate 15, i.e., that face confronting the pole and opposite from the winch, is provided with two parallel ribs 34, 35 which project rearwardly from the base of the plate and form a rectilinear groove which is adapted to receive the outermost portions of the mounting bracket parts 25, 32 and 24. The base of the groove serves to engage the confronting portions of the rear face of the plate between the ribs 34, 35 and mounting bracket surfaces holds the much place despite shifting of the takeoff position of the cable on the drum or presence of side loads.

The reason for providing the plate 15 with a symmetrical structure and the two openings 15*a*, 15*b* is to provide a means of reversing the position of the winch so that the cable can depend either from the inside of the drum or the outside of the drum, whichever the user prefers. Thus, where it may be desirable to shift the location of the vertical proportion of the cable at least the diameter of the drum, a change in the relationship can be made. Obviously the mounting is the same whether the mounting plate is engaged by the opening 15*a* or 15*b*.

Turning again to FIG. 1 and referring to the valve 21 for controlling the operation of the winch, this valve is preferrably mounted on a hanger bracket 36 which is adapted to be hung over the lip 37 of a basket 38 of the type carried by vehicle mounted aerial booms. This basket, or bucket as it sometimes is called, is mounted at the end of the boom and is adapted to carry worker(s) from a lower elevation to a convenient elevation near the top of the utility pole, utility lines or other structure so as to enable them to carry out appropriate tasks.

Figure 5:
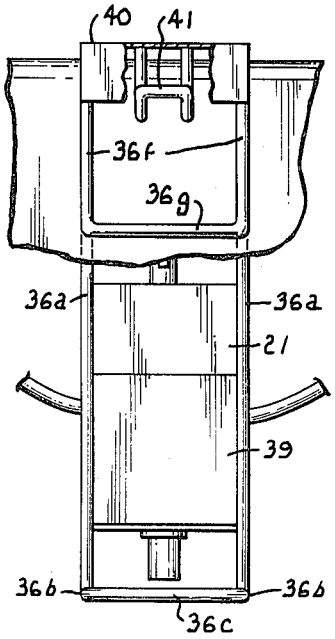
FIG. 5 is a partly sectional view taken along line 5—5 of FIG. 1 in the direction of the arrows.

The hanger bracket 36 is preferably constructed generally from metal rod formed to provide the appropriate configuration. Referring to FIG. 5, there are two parallel side rod portions 36*a* which are joined with an inturned generally U-shaped portion 36*b* and a cross-over portion 36*c*. The cross-over portion is adapted to bear against the side of the basket 38 as shown in FIG. 1. A mounting plate 39 is secured to and bridges between the rod portions 36*a*. The valve is mounted to the mounting plate 39.

At the upper end the rod portions 36*a* are bent inwardly and downwardly to provide respectively, cross-over portions 36*b* which overlie the lip 37 of the basket and downturned inside portions 36*f* which are joined by a cross-over 36*g*.

A generally U-shaped cover plate 40 is secured, as by welding, to the upper end of the hanger bracket and provides support for the legs of a smaller tongue-like member 42 which extends inwardly into the basket away from the plane of the down turned legs 36*f* with a slight upward inclination as shown in FIGS. 1 and 5. The tongue 41 is also preferably formed of bent rod having legs which extend upwardly inside the cap or cover piece 40 and are secured thereto by welding or other appropriate means.

It will be evident that the hanger bracket 36 with the valve thereon can easily be removed and replaced on a basket simply by lifting it to the point where it is free of the upper lip 37.

When in mounted position the tongue 41 of the bracket serves as a convenient hanger for a detached winch, as shown in the broken lines in FIG. 1.

The manner of mounting and utilization of the winch assembly is believed fairly evident from the foregoing description. In moving the equipment to the pole the winch and its pole support bracket are separated with the winch preferably being hung on the tongue 41 in the basket. The operator maneuvers the basket through the usual operating controls (not shown) into a position adjacent to the pole so that he can quickly connect the mounting bracket to the pole to the coupling and tightening of the strap 29.

The winch itself is then removed from the tongue and placed on the bracket in the manner illustrated in FIG. 3, i.e., by fitting one of the openings 15*a* in the base plate over the lip 33 and flange 33*b* and letting the winch move into its stablized position on the bracket. The operator is now free to move the basket at will and to control the operation from the basket through the medium of the valve 21.

The winch can quickly be removed and replaced as desired. Moreover, it can be reversed in position to shift the cable takeoff point from one end of the drum to the other or to the inside or outside of the drum.

The winch and mounting bracket are effectively locked together in such manner that the winch is held in place without swinging, rocking or moving out of place as the lift cable traverses the drum thereby achieving a fully stablized structure.

Figure 6:
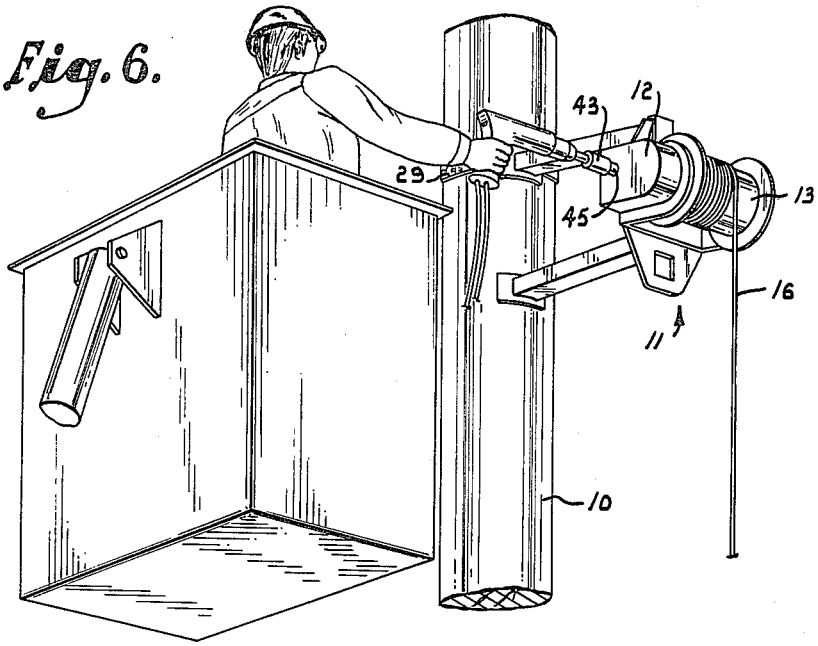
FIG. 6 is a perspective view showing a modified form of the invention.
Figure 7:
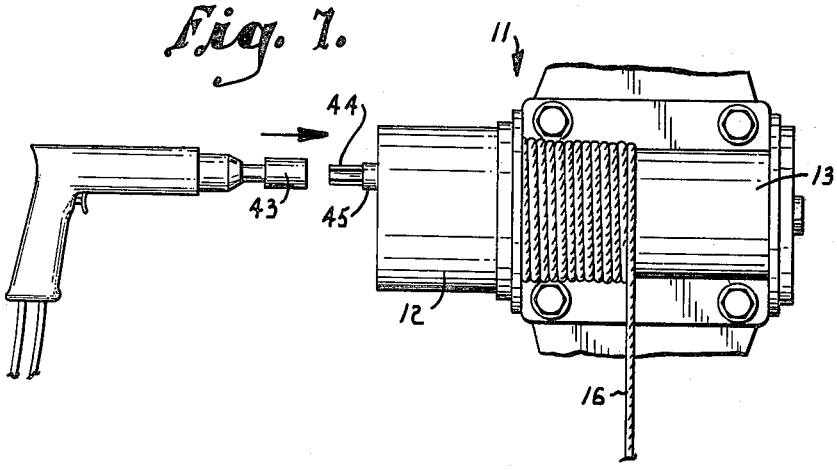
FIG. 7 is a fragmentary plan view illustrating the modified form in more detail.

Referring now to FIGS. 6 and 7, in the modified form of the invention, power for operating the winch is supplied by a hand held drill, which preferably is a pneumatically powered drill. The drill can be any available commercial unit. The only addition to it that need be made is to fit it with a wrench socket 43 which is adapted to be coupled with a tool head 44 (such as a hex head) formed on the drive shaft 45 to the worm drive speed reducer 12 of the winch.

In the modified form there are no hydraulic or other power supply lines interconnecting the basket and the winch, thereby providing a somewhat greater degree of freedom of movement for the basket. This arrangement has as additional advantage in that the power source is in the form of a tool that the worker can use for other purposes when the winch is not being operated.

From the foregoing it will be seen that this invention is one well adapted to attain all the ends and objects hereinabove set forth, together with other advantages which are obvious and which are inherent to the structure.

It will be understood that certain featured and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

Having thus described our invention, we claim:

1. The combination of a portable winch equipped with a cable and a mounting bracket for supporting the winch from a pole, said mounting bracket comprising a bracket support portion adapted to be removably secured to the pole and a winch coupling portion to be spaced from the pole, said coupling portion including a projection having a substantially horizontal axis and terminating in an upwardly projecting lip, said winch having a base plate provided with an opening therethrough near one end for fitting over said lip and projection, the upper portion of the opening bearing on said projection thereby to suspend the winch from the projection with the lip preventing removal of the winch by axial movement along the projection, said coupling portion of said bracket and base plate of said winch having cooperating abutting vertically oriented surfaces located remote from said opening which, when the winch is suspended on said projection, operate to prevent pivotal movement of said winch in any direction with respect to the pole except pivotal movement of said base plate and winch outwardly with the pivot axis coinciding generally with the portion of the opening bearing on the projection.

2. The combination of a portable winch equipped with a cable and a mounting bracket for supporting the winch from a pole, said mounting bracket comprising a bracket support portion adapted to be removably secured to the pole and a winch coupling portion to be spaced from the pole, said coupling portion including a projection having a substantially horizontally axis and terminating in an upwardly projecting lip, said winch having a base plate provided with an opening therethrough near one end for fitting over said lip and projection, said projection and opening having confronting rectilinear surfaces operable to inhibit rotation of the base plate and winch about the axis of the projection, the upper portion of the opening bearing on said projection thereby to suspend the winch from the projection with the lip preventing removal of the winch by axial movement along the projection, said coupling portion of said bracket and base plate of said winch having cooperating abutting vertically oriented surfaces located remote from said opening which, when the winch is suspended on said projection, operate to prevent pivotal movement of said winch in any direction with respect to the pole except pivotal movement of said base plate and winch outwardly with the pivot axis coinciding generally with the portion of the opening on the projection.

3. The combination as in claim 1, said abutting surfaces comprising a pair of spaced vertical ribs on the base plate defining a groove and vertical surfaces on the bracket received within and confined by the groove.

4. The combination of a portable winch equipped with a cable and a mounting bracket for supporting the winch from a pole, said mounting bracket comprising a bracket support portion adapted to be removably secured to the pole and a winch coupling portion to be spaced from the pole, said coupling portion including a projection having a substantially horizontal axis and terminating in an upwardly projecting lip, said lip having a horizontal flange overlying said projection, said winch having a base plate provided with an opening therethrough near one end for fitting over said lip and projection, the upper portion of the opening bearing on said projection thereby to suspend the winch from the projection with the lip preventing removal of the winch by axial movement along the projection, said coupling portion of said bracket and base plate of said winch having cooperating abutting vertically oriented surfaces located remote from said opening which, when the winch is suspended on said projection, operate to prevent pivotal movement of said winch in any direction with respect to the pole except pivotal movement of said base plate and winch outwardly with the pivot axis coinciding generally with the portion of the opening bearing on the projection.

5. In combination with an upright utility pole of substantial height, a portable winch including a winch drive motor, a winch mounting bracket for connection with the pole and an upper portion thereof, said winch mounting bracket being connected with the pole independently of the winch with the winch connectable to the bracket after installation of the bracket on the pole, an operator's basket on an aerial boom for carrying an operator and said winch and bracket to the point of connection of the bracket with the pole to permit installation of the winch and removal of the winch therefrom by the operator, power control means for said winch a hanger bracket mounted on said basket and including means for mounting said control means thereto, said control means operable by the operator to control the operation of the winch from the basket at varying positions of the basket relative to the winch, said hanger bracket including a U-shaped portion adapted to removably fit over an upper edge of the basket, said means for mounting said control means being located on that portion of the hanger bracket outside the basket, said hanger bracket further including a tongue projecting from that portion of the bracket located inside the basket, said portable winch including a base plate having an opening therein, said opening adapted to fit over said tongue thereby to suspend the winch from the tongue when the winch is located in the basket and not on the pole.

6. In combination with an upright utility pole of substantial height, a portable winch including a winch drive motor, a releasable winch mounting bracket connected with the pole at an upper portion thereof, means connecting said winch with said winch mounting bracket whereby the winch may be quickly mounted on and removed from said bracket, said winch mounting bracket being connectable with the pole independently of the winch with the winch connectable to the bracket after installation of the bracket on the pole, an operator's basket on an aerial boom for carrying an operator and said winch and bracket to the point of connection of the bracket with the pole to permit installation of the bracket and then the winch and removal of the winch from the bracket and the bracket from the pole by the operator, and power control means for said winch, said control means carried by the basket and operable by the operator to control the operation of the winch from the basket at varying positions of the basket relative to the winch.

7. The combination as in claim 6, including a hanger bracket mounted on said basket, said hanger bracket including means for mounting said control means thereto and means for supporting said winch when it is not on the pole.

8. The combination as in claim 7, said basket having an upper edge, said hanger bracket including an U-shaped portion adapted to removably fit over the edge of the basket, said means for mounting said control means being located on that portion of the hanger bracket outside the basket.

9. The combination of a portable winch equipped with a cable and a mounting bracket supporting the winch from a pole, said mounting bracket comprising a bracket support portion adapted to be removably secured to the pole and a winch coupling portion to be spaced from the pole, said coupling portion including a projection having a substantially horizontal axis and terminating in an upwardly projecting lip, said winch having a winch drum and a base plate on which the drum is mounted, said base plate having a pair of openings therethrough, one above the winch drum and the other below the winch drum, said openings being selectively fittable over said lip and projection, the upper portion of the opening fitted over the projection bearing on the projection thereby to suspend the winch from the projection with the lip preventing the removal of the winch by axial movement along the projection said openings permitting selective reversal of the position of the winch on the bracket, said coupling portion of said bracket and base plate of said winch having cooperating abutting vertically oriented surfaces located remote from the respective openings which, when the winch is suspended on said projection with either opening engaged with the projection, operate to prevent pivotal movement of said winch in any direction with respect to the pole except pivotal movement of said base plate and winch outwardly with pivot axis coinciding generally with the portion of the opening bearing on the projection.

* * * * *